United States Patent [19]

Ito et al.

[11] Patent Number: 4,519,957

[45] Date of Patent: May 28, 1985

[54] VARIABLE-VENTURI CARBURETOR

[75] Inventors: Takaaki Ito; Takashi Kato, both of Mishima, Japan

[73] Assignee: Toyota Jidosha Kabushiki Kaisha, Toyota, Japan

[21] Appl. No.: 650,566

[22] Filed: Sep. 13, 1984

Related U.S. Application Data

[63] Continuation of Ser. No. 429,431, Sep. 30, 1982, abandoned.

[30] Foreign Application Priority Data

Dec. 9, 1981 [JP] Japan ..... 56-196885

[51] Int. Cl.[3] ..... F02M 9/06

[52] U.S. Cl. ..... 261/44 C; 261/DIG. 39

[58] Field of Search ..... 261/44 C, DIG. 56, DIG. 39

[56] References Cited

U.S. PATENT DOCUMENTS

| | | | |
|---|---|---|---|
| 2,229,819 | 1/1941 | Reid | 261/DIG. 39 |
| 3,424,441 | 1/1969 | Caisley et al. | 261/44 C |
| 4,132,752 | 1/1979 | Petermann | 261/DIG. 39 |
| 4,221,747 | 9/1980 | Edmonston | 261/44 B |
| 4,264,537 | 4/1981 | Watanabe et al. | 261/44 C |
| 4,302,405 | 11/1981 | Inoue et al. | 261/52 |
| 4,305,893 | 12/1981 | Morino | 261/44 C |
| 4,371,478 | 2/1983 | Wada | 261/DIG. 39 |
| 4,377,538 | 3/1983 | Wada | 261/44 C |

*Primary Examiner*—Tim Miles

*Attorney, Agent, or Firm*—Finnegan, Henderson, Farabow, Garrett & Dunner

[57] ABSTRACT

The main fuel nozzle is located a predetermined distance inside from the end of a bridge formed in the upstream portion of the barrel of the carburetor, and the piston head of the suction piston is designed to be overlapped by the bridge during the idle condition. A notch is also formed on the downstream side of the main nozzle to shift the fuel running along the metering needle during idling to the main nozzle by a diffusing air flow, and a fuel guide is provided extending from the notch to the barrel wall to guide the fuel, supplied from the main nozzle during idling, along the fuel guide surface to the barrel wall.

3 Claims, 5 Drawing Figures

VARIABLE-VENTURI CARBURETOR

This application is a continuation of application Ser. No. 429,431, filed Sept. 30, 1982, now abandoned.

FIELD OF THE INVENTION

The present invention relates to the technical field of fuel delivery and, in particular, to the stabilization of the air-fuel ratio of the fuel mixture delivered during idling from a variable venturi carburetor used in automotive engines.

DESCRIPTION OF THE PRIOR ART

As is known, the variable-venturi carburetor has found wide use in automobiles from sports cars to ordinary passenger cars because of various advantages such as the small height of the carburetor body, the good transient response characteristics and because it does not require a slow speed system.

There are, however, various problems that need to be improved upon in variable-venturi carburetors.

For one, such carburetors have the drawback of unstable air-fuel ratio during idling. As shown in FIG. 1, during idling or light-load operation (this shall be simply referred to as an ilding condition), the suction piston 2 is located close to the bridge 3 leaving a very small opening in venturi 4. The amount of fuel supplied by the metering needle 6 and the main jet 10, provided in the well 9, is small. Well 9 communicates with the float bowl 7 through pipe 8. This small amount of fuel passes the main jet 10 along the metering needle 6 and comes out of the main nozzle 11. As the fuel droplets move down the head 5 of the suction piston 2, they combine into larger drops which collect at the lower edge of the suction piston head 5 until they grow into sufficiently large drops 13 to fall into the throttle valve 12. This occurs periodically.

Consequently, as shown in FIG. 2, with abscissa representing time and ordinate representing the air-fuel ratio, the air-fuel ratio cyclically becomes excessively rich as indicated at spikes C, which correspond to the periodical fall of fuel drop. As a result, the engine revolution abruptly increases or surges each time the fuel drops fall, causing unstable idling operation which in turn produces an annoying engine noise, vibration of the engine and vehicle or unstable running of the vehicle.

SUMMARY OF THE INVENTION

The primary object of this invention is to provide an improved variable-venturi carburetor which solves the problem of unstable air-fuel ratio of the fuel mixture delivered from the conventional variable-venturi carburetor during idling; and the second object is to provide a variable-venturi carburetor which is small in height, has improved wear resistance of the metering needle and improved needle fabrication.

Additional objects and advantages of the invention will be set forth in part in the description which follows, and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, as embodied and broadly described herein the variable-venturi carburetor of this inveniton comprises a barrel, a throttle valve mounted in the interior, downstream poriton of said barrel, a bridge formed in the upstream portion of said barrel and projecting outwardly into the interior of said barrel, a suction chamber provided on the side of said barrel adjacent to a venturi section formed in the interior of barrel between said throttle valve and said bridge, a suction piston slidably fitted into said suction chamber and adapted to move back and forth in the venturi section, said suction piston having a piston head, said piston head designed at its upstream portion to be overlapped by said bridge in the ilding condition, a metering needle projecting outwardly from said suction piston head, a well, a main nozzle formed at the front end of said well and projecting outwardly a predetermined distance into the venturi section, a notch formed on the downstream side of said nozzle, a main jet formed in said well, said metering needle inserted through said main nozzle into said main jet, and a float chamber, said well being connected to said float chamber.

The accompanying drawings, which are incorporated in and constitute a part of this specification, illustrate an embodiment of the invention and, together with the description, serves to explain the principles of the invention.

DETAILED DESCRIPTION OF THE PREFERRED EMBODIMENT

Figure 3:
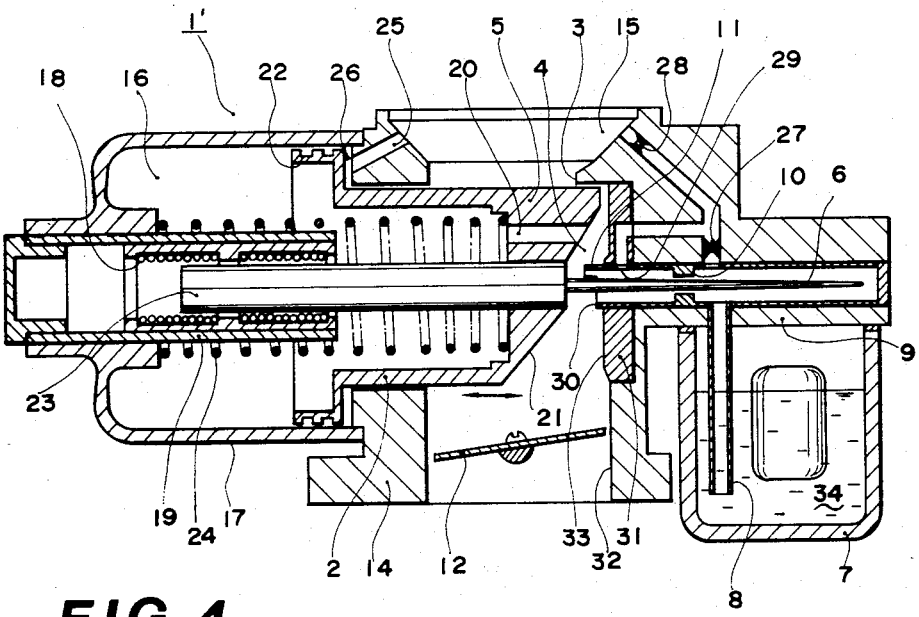
FIG. 3 is a cross section of a preferred embodiment of a variable-venturi carburetor constructed in accordance with this invention.
Figure 4:
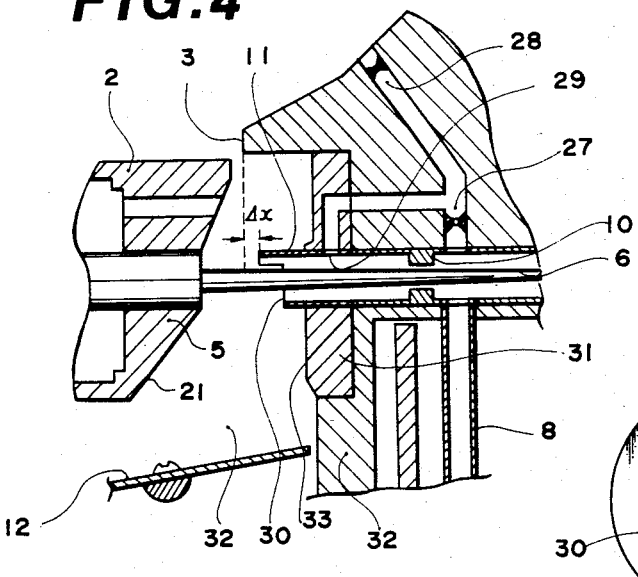
FIG. 4 is an enlarged cross section of a portion of the preferred embodiment of the carburetor illustrated in FIG. 3.
Figure 5:
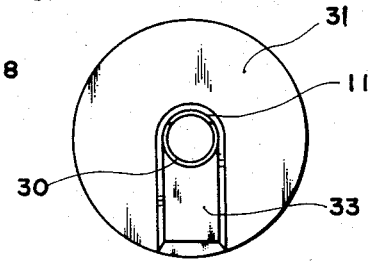
FIG. 5 is a front view of the fuel guide shown in FIGS. 3 and 4.

Referring to FIGS. 3, 4 and 5, the preferred embodiment of this invention will now be, described. The members shown in these figures corresponding to those in FIG. 1 carry like reference numbers.

Generally designated 1' is a variable-venturi carburetor which has a venturi 4 formed between the throttle valve 12 downstream in the barrel 14 and the air horn 15 in the upstream portion of the barrel 14. On one side of the venturi 4 is provided a suction chamber 17 forming a vacuum chamber 16. A rod guide 19 with bearings 18 is installed projecting inside the suction chamber 17. A suction piston 2 which has a suction hole 20 formed in the upstream portion of its head 5 and an inclined surface 21 formed at the downstream portion is slidably fitted into the suction chamber 17 by means of a labyrinth seal 22. A center rod 23 attached to piston 2 is slidably supported on the bearing 18 of the rod guide 19 so that hysteresis can be made very small. A damper spring 24 is fitted over the rod guide 19 and positioned between the base of the suction chamber 17 and the suction piston 2. Formed at the front flange surface of the suction chamber 17 between the barrel 14 and the suction piston is an atmospheric chamber 26 that communicates with the air horn 15 through a hole 25.

Figure 1:
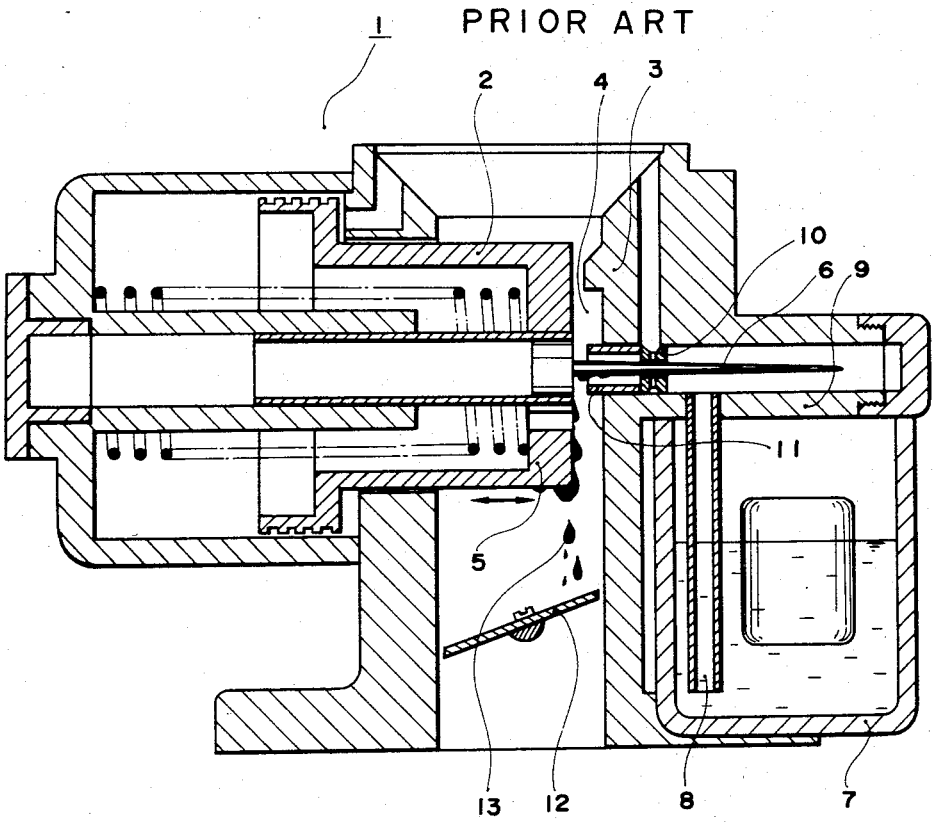
FIG.1 PRIOR ART
FIG. 1 is a cross section of a conventional variable-venturi carburetor showing how fuel droplets are formed during idling.
Figure 2:
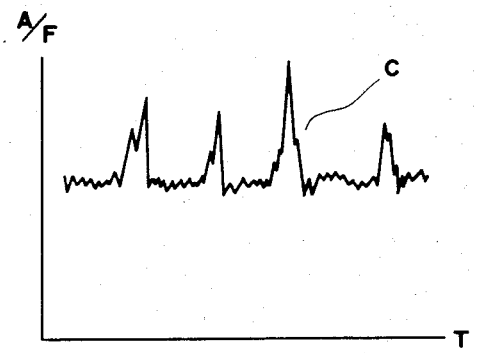
FIG. 2 is a graph showing the variation in air-fuel ratio arising from the dripping of fuel.

As can be seen by comparing FIGS. 1 and 3, the throttle valve 12 is placed a higher position within the barrel, and the height of the carburetor is made smaller becauce of the inclined surface 21 of suction piston head 5.

Formed opposite to the suction chamber 17 with respect to the venturi 4 is a well 9 connected through a pipe 8 to the float bowl 7. A metering needle 6 secured to and projecting from the suction piston head 5 is loosely inserted into the well 9 passing through a main nozzle 11 at the front end of the well and a main jet 10 formed inside the well.

Connected immediately behind the main jet 10 of the well 9 is a bypass jet 27, as detailed in FIG. 4, which in turn is connected to an airbleed jet 28 of the air horn 15 and also to a jet 29 opening immediately behind the main nozzle 11.

The main nozzle 11, as shown, projects from the barrel 14 so that its front end is recessed a predetermined distance $\Delta x$ back from the front end of the bridge 3 toward the main jet 10. The nozzle is formed with a step made by a notch 30 which is cut form slightly above the center downward. Our experiments show that the optimum width of the notch is 2 to 6 mm.

Around the main nozzle 11 is provided a disk-shaped fuel guide 31 which has a raised surface 33 to provide a smooth geometrical transition from the notch 30 to the mixing chamber wall 32. Raised surface 33 is offset inwardly from notch 30 to provide a step between the downstream side of the notch and raised suface 33, as shown in FIG. 4. The lower edge of the fuel guide is tapered to prevent any interference with the rotation of the throttle valve 12 thereby enabling the throttle valve to be located at as high a position as possible.

In the above construction, as the engine is started, a vacuum is created in the mixing chamber according to the opening degree of the throttle valve 12. The vacuum thus created is introduced into the vacuum chamber 16 of the suction chamber 17 through suction hole 20. The suction piston 2 stops at the lateral position where the forces resulting from the vacuum pressure, the atmospheric pressure in the chamber 26 and the damper spring 24 balance each other. Thus the area of the venturi 4 is determined according to the air intake.

The negative pressure at the venturi is admitted into the well 9 through the main nozzle 11 and causes the fuel 34 in the float bowl 7 to come up through the pipe 8. Some of the fule introduced into the well 9 is then metered by the main jet 10 and the metering needle 6, and some fuel passes through the bypass jet 27 and mixes with the bleed air introduced from the airbleed jet 28. These fuels combine at the main nozzle 11 and are delivered into the mixing chamber.

During idling, the suction piston 2 provides only a small venturi 4, as shown in FIG. 3, with the upper portion of the head 5 being overlapped by the bridge 3. Consequently, the negative pressure at the venturi 4 is low and the amount of fuel 34 delivered from the mian nozzle 11 is small, so that almost all the fuel from the main jet 10 and the jet 29 is fed along the base portion of the metering neddle 6.

However, since the air taken in from the air horn 15 during idling is contracted by the bridge 3, the air will be diffused at the venturi 4 giving pressure impact to the main nozzle 11. The notch 30 allows the diffusing air flow to continuously carry downstream the fuel 34 that has moved to the base of the metering needle 6.

The result of our experiment shows that for the maximum metering needle diameter of 3 mm, the inner diameter of the main nozzle, for which the fuel is readily shifted downstream from the metering needle by the diffusing air flow, is 4 to 6 mm.

The fuel thus carried downstream of the main nozzle 11 from the notch 30 is further carried down the raised surface 33 of the fuel guide 31 by the diffusing air flow. The fuel then continuously flows down the wall 32 of the mixing chamber. This prevents the air-fuel ratio of the fuel mixture from becoming periodically excessively rich such as caused by fuel dripping observed with the conventional variable-venturi carburetor. This in turn ensures that the engine revolutions remain stable.

The notch 30 increases negative pressure at the main nozzle 11 allowing a greater amount of fuel to be supplied from the nozzle. If fuel droplets are formed on the suction piston head 5, they will flow slowly down the inclined surface and be atomized before they reach the lower edge of the head 5 and develop into large drops of fuel.

Since the notch 30 helps increase the negative pressure applied to the main nozzle 11 as mentioned above, the metering needle can be formed straight without any taper or the taper moderated for the large air intake region, which in turn reduces wear of the main jet and the needle caused by vibration and facilitates the fabrication of the metering needle.

It should be noted that the invention is not limited to the above embodiment along and that various modifications may be made. For example, it is possible to form a guide groove in the fuel guide 31 which curves from the notch 30 to the mixing chamber wall 32. In this case, the guide groove may be formed so that the upper part of the guide groove will smoothly merge into the notch.

The features of this invention may be summarized as follows.

The front end of the main nozzle projecting from the barrel wall is recessed a predetermined distance from the front end of the bridge upstream toward the barrel wall so that during the idling operation the air taken in is compressed at the bridge and diffused at the venturi. This causes a positive drawing out of the fuel from the main nozzle downwardly, thereby preventing the fuel from being transferred from the metering rod to the suction piston head and then dripping therefrom.

The diffusion of fuel will be further improved if the downstream side of the piston head is inclined.

The notch provided downstream side of the main nozzle helps create a vacuum as the diffusing air flow passes by, so that the fuel that has passed the main jet and is moving along the base portion of the metering needle can be carried down toward a fuel guide 31. As a result the fuel can be prevented from being transferred along the metering needle to the suction piston head where it will form into large droplets and drip. This turn assures a stable air-fuel ratio and therefore stable engine revolution.

Further, the fuel guide stretching from the notch to the mixing chamber wall assures smooth and continuous flow of fuel into the mixing chamber, helping to stabilize the air-fuel ratio.

Furthermore, since the vacuum is increased by the presence of the notch, the metering needle can be made larger in diameter for the medium and high air intake region, so that the main jet and needle can be protected against the wear due to friction caused by virbration.

The larger diameter of the metering needle facilitates needle fabrication.

In addition, the inclined surface of the suction piston head prevents interference between the piston head and the throttle valve, which it turn allows the throttle valve to be located at a higher position within the barrel, resulting in a reduced height for the carburetor body.

What is claimed is:

1. A variable-venturi carburetor comprising: a barrel; a throttle valve mounted in the interior, downstream poriton of said barrel; a bridge formed in the upstream poriton of said barrel and projecting outwardly into the interior of said barrel; a suction chamber provided on the side of said barrel adjacent to a venturi section formed in the interior of said barrel between said throttle valve and said bridge; a suction piston slidably fitted into said suction chamber and adapted to move back and forth in the venturi section; said suction piston having a piston head; said piston head designed at its upstream portion to be overlapped by said bridge in the idling condition; and metering neddle projecting outwardly from said suction piston head; a well; a main nozzle formed at the front end of said well and projecting outwardly a predetermined distance into the venturi section; a notch formed on the downstream side of said nozzle; a main jet formed in said well; said metering needle inserted through said main nozzle into said main jet; a float chamber; said well being connected to said float chamber; a fuel guide positioned in the venturi section adjacent to said nozzle and havnig a raised surface formed below said nozzle and offset inwardly from said notch, and having a tapered surface at its downstream portion which merges smoothly into the barrel wall to provide a smooth transition for the flow of fuel.

2. A variable-venturi carburetor as claimed in claim 1, wherein said piston head at its downstream portion has an inclined surface.

3. A variable-venturi carburetor as claimed in claim 1 or 2 wherein said piston head at its upstream portion has an inclined surface.

* * * * *